United States Patent [19]

Meier

[11] 4,140,052

[45] Feb. 20, 1979

[54] APPARATUS FOR COMPRESSING A STACK OF FOLDED, ESSENTIALLY FLAT PRODUCTS, ESPECIALLY PRINTED PRODUCTS

[75] Inventor: Jacques Meier, Gossau, Switzerland

[73] Assignee: Ferag AG, Hinwil, Switzerland

[21] Appl. No.: 855,412

[22] Filed: Nov. 28, 1977

[30] Foreign Application Priority Data

Oct. 24, 1977 [CH] Switzerland ..... 12893

[51] Int. Cl.[2] ..... B30B 7/00

[52] U.S. Cl. ..... 100/233; 93/93 DP; 100/264; 100/266; 100/295

[58] Field of Search ..... 100/215, 233, 244, 266, 100/268, 295, 3, 238, 264, 223, 295; 93/93 DP

[56] References Cited

U.S. PATENT DOCUMENTS

| | | | |
|---|---|---|---|
| 467,783 | 1/1892 | Sailor | 100/244 |
| 3,115,090 | 12/1963 | Elander | 100/223 X |
| 4,045,152 | 8/1977 | Peterson | 100/268 |

FOREIGN PATENT DOCUMENTS

| | | | |
|---|---|---|---|
| 1,273,979 | 9/1961 | France | 100/214 |

*Primary Examiner*—Billy J. Wilhite
*Attorney, Agent, or Firm*—Werner W. Kleeman

[57] ABSTRACT

An apparatus for compressing or squeezing a stack of folded, essentially flat products, especially printed products, comprising a stack receiver compartment closed at its lowr end by a support element and a counter pressure device arranged above the support element. The support element and the counter pressure device are movable relative to one another, in order to press together the stack arranged between the counter pressure device and the support element. The counter pressure device comprises at least one pressing element pivotable about an essentially horizontal pivot axis. The pressing element spans over the stack receiver compartment in the direction of the pivot axis. This pressing element can be rocked upwardly by a product stack, out of a lower pivotal position inclined in the direction of the support element, against the action of at least one pressure element acting upon the pressing element.

10 Claims, 4 Drawing Figures

APPARATUS FOR COMPRESSING A STACK OF FOLDED, ESSENTIALLY FLAT PRODUCTS, ESPECIALLY PRINTED PRODUCTS

BACKGROUND OF THE INVENTION

The present invention relates to a new and improved construction of apparatus for squeezing together or compressing a stack of folded, essentially flat products, especially printed products, which is of the type comprising a stack receiver compartment closed at its lower end by a support element and a counter pressure device arranged above the support element, the support element and the counter pressure device being movable relative to one another, in order to press together the product stack arranged between the counter pressure element and the support element.

With such types of equipment there is provided, for instance, a counter pressure plate against which there is pressed the stack by raising a support table. In this way, the stack can be squeezed or pressed together. Since the stack is higher at that side where the printed products bear against one another at their fold (spine), than at the opposite side, the so-called "cut edges" or "flower", upon squeezing together the stack the higher situated side is initially brought into contact with the counter pressure plate. This can result in undesirable shifting of the printed products. Consequently, it is possible for there to occur the formation of folds upon the uppermost printed product of the stack.

SUMMARY OF THE INVENTION

Hence, with the foregoing in mind it is a primary object of the present invention to overcome the aforementioned drawbacks of the prior art equipment.

Another and more specific object of the present invention aims at the provision of a new and improved construction of apparatus of the previously mentioned type which is designed in such a manner that during squeezing together or compression of the product stack, the printed products or other articles in the stack do not undesirably shift and there cannot arise any damage to the products.

Still a further significant object of the present invention aims at an improved construction of apparatus for compressing a stack of folded, essentially flat products, which apparatus is relatively simple in construction and design, economical to manufacture, easy to use, not readily subject to breakdown or malfunction, and squeezes together the products of the stack in a protective and reliable manner.

Now in order to implement these and still further objects of the invention, which will become more readily apparent as the description proceeds, the apparatus of the present invention is manifested by the features that the counter pressure device comprises at least one pressing element mounted to be pivotable about an essentially horizontal pivot axis or shaft, the pressing element spanning the product stack-receiver compartment in the direction of the pivot axis. The pressing element can be upwardly rocked by the product stack, out of a lower pivotal position inclined in the direction of the support element, against the action of at least one pressure element acting upon the pressing element.

The pressing element which is inclined in the direction of the support element, during movement towards one another of the support element and the counter pressure device, initially presses upon the central region of the stack. Thereafter, the pressing element exerts a pressure upon the stack from such central or intermediate region towards the outer situated edges. The products are thus fixedly positionally held right at the start of the squeezing or compression action and cannot undesirably shift. Equally, there thus does not occur any damage to the products.

BRIEF DESCRIPTION OF THE DRAWINGS

The invention will be better understood and objects other than those set forth above will become apparent when consideration is given to the following detailed description thereof. Such description makes reference to the annexed drawings wherein throughout the various Figures there have been generally used the same reference characters for the same components and wherein.

DETAILED DESCRIPTION OF THE PREFERRED EMBODIMENTS

Figure 1:
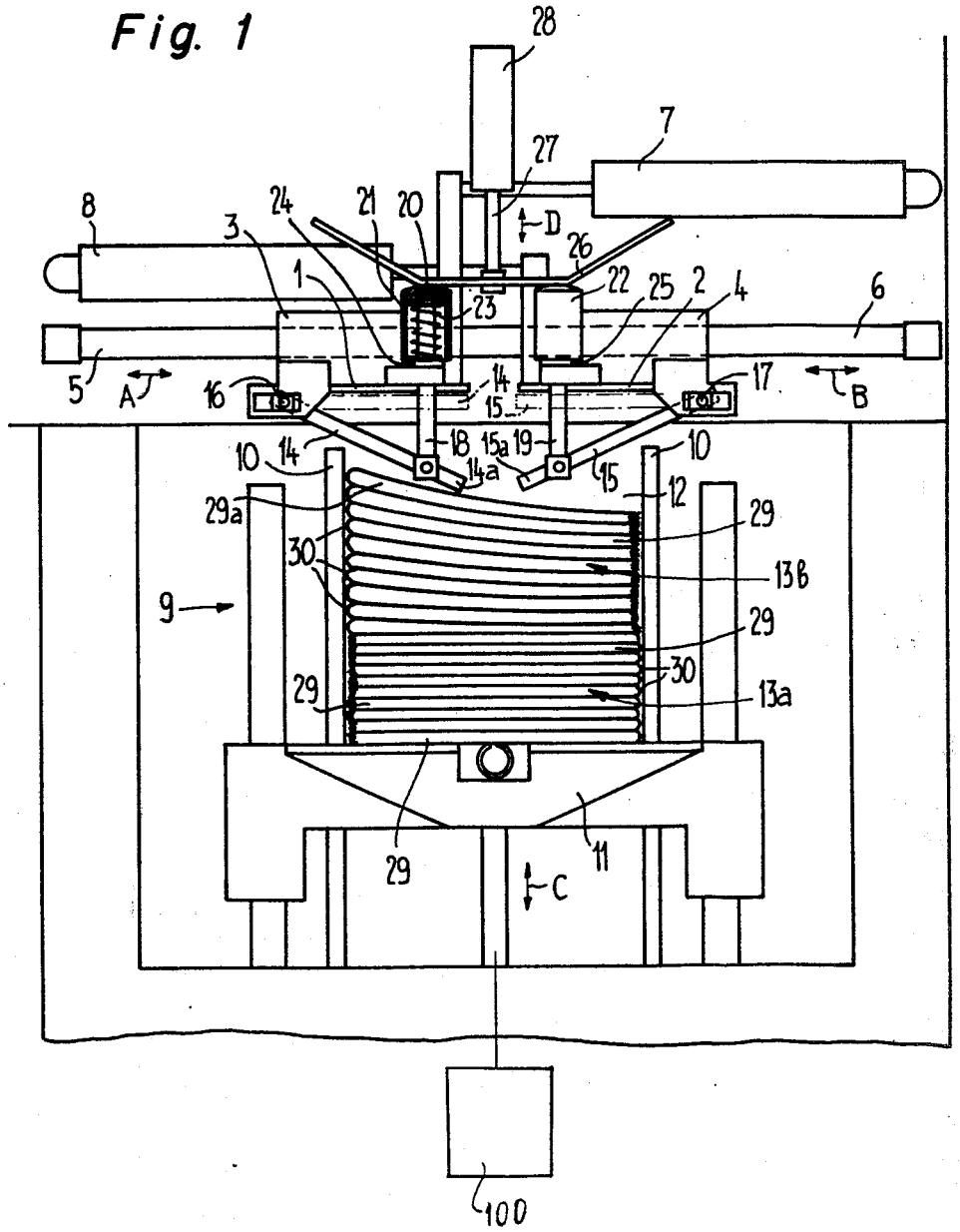
FIG. 1 schematically shows in elevational view an exemplary embodiment of apparatus for squeezing together or compressing stacked, folded products, here shown in the form of printed products.

Describing now the drawings, the exemplary embodiment of apparatus illustrated therein is equipped with a not particularly further shown stacker unit or device having an essentially vertical stacker or stacking chute defined by non-illustrated boundary ledges or the like. The printed products which are to be stacked are infed to the stacker chute by means of a likewise not particularly shown conveyor device, for instance a conveyor band and are stacked in such stacker chute. One suitable form of stacker unit, including the infeed device for the printed products, has been disclosed and constitutes the subject matter of the commonly assigned, United States application, Ser. No. 855,357 filed Nov. 28, 1977 entitled "Apparatus for Stacking Folded, Continuously Arriving Printed Products, Especially Products Arriving in an Imbricated Product Stream", to which reference may be readily had and the disclosure of which is incorporated herein by reference. In reality, the stacker unit and associated product infeed equipment does not constitute subject matter of the present invention and has merely been discussed above for background information and to further elucidate a possible environment with which the equipment of the present invention can be beneficially employed.

Continuing, the stacker chute is closed at its lower end by two slide plates 1 and 2, each of which are conveniently attached in any appropriate fashion to an associated carriage 3 and 4, respectively. Each of these carriages 3 and 4 is displaceably guided for to-and-fro movement in the direction of the double-headed arrows A and B, respectively, by means of the associated guides 5 and 6, respectively. In order to shift the carriages 3 and 4 and thus the slide plates 1 and 2 suitable drive means, for instance pneumatic or hydraulic piston-and-cylinder units 7 and 8 operatively act upon the carriages 3 and 4, respectively. The piston-and-cylinder unit 7 serves to move the associated carriage 3, whereas the piston-and-cylinder unit 8 moves the associated carriage 4. By displacing the slide plates 1 and 2 away from one another and towards one another, it will be appreciated that the stack or stacker chute can be selectively opened and closed at its lower end.

Below the stacker unit or device there is arranged a package forming unit or device 9, the geometric configuration of which is defined by the boundary ledges 10 or equivalent structure. The package forming device 9 has a product stack-receiver compartment 12 which is closed at its lower end by a support element, here shown as a support table 11. The receiver compartment 12 serves to receive the partial stack 13*a*, 13*b* of products which have been transferred thereto by the stacker unit. The support table 11 can be elevationally shifted, i.e., raised and lowered in the direction of the double-headed arrow C by means of the schematically shown drive 100 constituting a lifting and lowering device for such support table 11. Additionally, this support table 11 can be rotated through an angle of about 180° about its lifting and lowering axis, either by means of the drive 100 or through the use of another suitable rotating drive provided for such support table.

Now at each carriage 3 and 4, there is hingedly connected a pressing plate 14 and 15. These pressing plates 14 and 15 are pivotable about an essentially horizontal pivot shaft 16 and 17 or equivalent structure, defining pivot axes and mounted at the carriages 3 and 4 respectively. Each pressing or squeezing plate 14 and 15 extends in the direction of its pivot shaft or axis 16 and 17 practically over the entire width of the stack receiver or receiving compartment 12. At the region of the ends 14*a* and 15*a* of the pressing plates 14 and 15, respectively, located opposite the pivot shafts 16 and 17, respectively, there is hingedly secured at each such pressing plate a displaceable push rod 18 and 19 guided by the carriages 3 and 4, respectively, as shown. At the upper end each push rod 18 and 19 is fixedly connected by a bolt 20 or other suitable fastening expedient with an internally hollow housing 21 and 22, respectively, each such housing being open at its lower end. Within each housing 21 or 22 there is arranged a pressure or compression spring 23 which bears upon an associated counter support 24 and 25 mounted at the carriages 3 and 4, respectively. Each housing 21 and 22 bears upon the related pressure spring 23.

Bearing against both housings 21 and 22 is a pressure element 26 which is operatively connected with the piston rod 27 of an essentially vertically arranged pheumatic or hydraulic piston-and-cylinder unit or device 28. This piston rod 27 can be raised and lowered in the direction of the double-headed arrow D. When pressure is exerted by the piston-and-cylinder unit 28 the pressure element 26 presses against both of the housings 21 and 22 which, in turn, causes the push or pressure rods 18 and 19 to move downwards. As a result, the pressure springs 23 are compressed. Due to lowering of the push rods 18 and 19 the pressing or squeezing plates 14 and 15 are rocked into their lower pivotal position shown in full lines in FIG. 1 and are retained in such lowered pivotal position.

If the pressure exerted by the pressure element 26 upon the housings 21 and 22 disappears due to lowering of the pressure in the piston-and-cylinder unit 28, then the pressing or squeezing plates 14 and 15 are shifted upwardly, by the action of the pressure springs 23 into the phantom-line illustrated upper pivotal position.

Having now had the benefit of the foregoing description of the preferred embodiment of apparatus of the invention, its mode of operation will now be considered as follows:

Now in FIG. 1 of the drawing the apparatus has been shown prior to squeezing or pressing the partial stack 13*b*. The individual printed products 29 or otherwise of each partial stack 13*a* and 13*b* are located such that their fold or folded portion 30 (spine) bear against one another, wherein, however, both of the partial stacks 13*a* and 13*b* are turned 180° relative to one another so that in the showing of FIG. 1 the fold 30 of each of the printed products 29 of the lower partial stack 13*a* is located at the right side and the fold 30 of each of the printed products 29 of the upper partial stack 13*b* is located at the left side. The lower partial stack 13*a* has already been previously pressed together, whereas the upper partial stack 13*b* has not yet been compacted. It is for this reason that the partial stack 13*b* is still higher at that side at which the printed products 29 bear against one another by means of their respective fold 30 than at the opposite side.

As already mentioned the press or squeezing plates 14 and 15 are retained in their lower pivotal position by the piston-and-cylinder unit 28. By raising the support table 11 both of the partial stacks 13*a* and 13*b* are moved upwardly against the pressing or squeezing plates 14 and 15. As a result, both of the end regions 14*a* and 15*a* of both pressing plates 14 and 15, respectively, and which extend neighboring one another approximately at the center of the stack receiver compartment 12, come to nest upon the uppermost printed product 29*a* of the partial stack 13*b*. These end regions 14*a* and 15*a* initially only press at the region of the center of the printed products 29 upon the partial stack 13*b*. As illustrated in FIG. 1, due to the inclination of the partial stack 13*b*, first only the pressing plate 14 and then also the pressing plate 15 come into contact with the printed product 29*a*. During further raising of the support table 11 the pressing plates 14 and 15 are rocked by the stack 13*a*, 13*b* upwardly towards the upper pivotal position in opposition to the counter pressure exerted by the piston-and-cylinder unit 28. As a result, the partial stack 13*b* is simultaneously compressed or squeezed together. During this rocking of the pressing or squeezing plates 14 and 15 upwardly, the uppermost printed product 29*a* gradually comes into contact from the central region towards both of the side or lateral edges with the pressing plates 14 and 15, so that the partial stack 13*b* is squeezed together from the central region towards the sides. Since during lifting of the support table 11 and the partial stacks 13*a*, 13*b* a counter pressure is exerted from the pressure-loaded pressing plates 14 and 15 upon the partial stack 13*b*, the printed products 29 which bear loosely upon one another are squeezed together, until the free surface of the uppermost printed product 29*a*, serving as the support surface for the next partial stack, is approximately horizontal.

During the described pressing or squeezing operation there is formed a new partial stack within the stacking compartment of the stacker unit. After completion of the pressing or squeezing operation the slide plates 1 and 2 are moved away from one another by appropriately shifting the carriages 3 and 4, respectively, and at the same time the pressing plates 14 and 15 are rocked into the upper pivotal position, by the action of the pressure springs 23 when the piston-and-cylinder unit 28 is vented, and in which upper pivotal position these pressing plates 14 and 15 bear against the slide plates 1 and 2, respectively. With the slide plates 1 and 2 in the open position there is now placed onto the previously compacted or squeezed together partial stack 13*b*, the new partial stack located in the stacking chute of the stacker unit. During opening of the slide plates 1 and 2 the support table 11 has been lowered somewhat and turned through 180° so that the new partial stack comes to bear upon the partial stack 13*b* rotated through an angle of 180° with respect to such partial stack 13*b*.

The slide plates 1 and 2 are now brought into their closed position by displacing the carriages 3 and 4, respectively, and the pressing plates 14 and 15 are rocked into their lower pivotal position by means of the piston-and-cylinder unit 28 and held in this lower pivotal position, as has been shown in FIG. 1. Thereafter, there is accomplished in the already described manner a renewed squeezing together of the stack.

Figure 2:
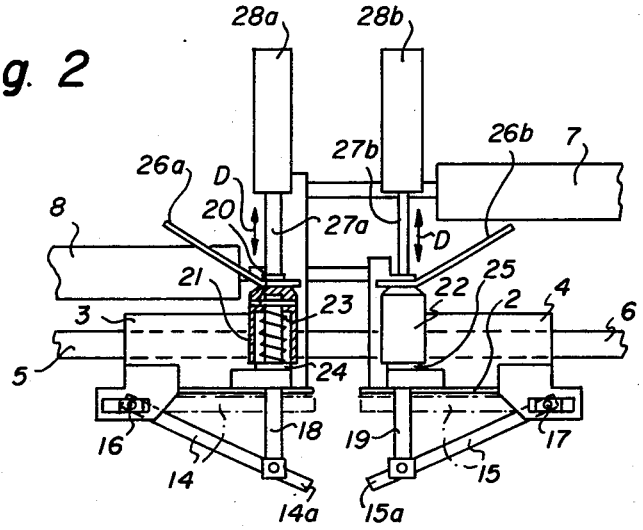
FIG. 2 illustrates part of a modification of the arrangement shown in FIG. 1, employing a separate hydraulic or pneumatic piston-and-cylinder unit for each pressing plate, and wherein the remaining structure otherwise is like that shown in FIG. 1.
Figure 3:
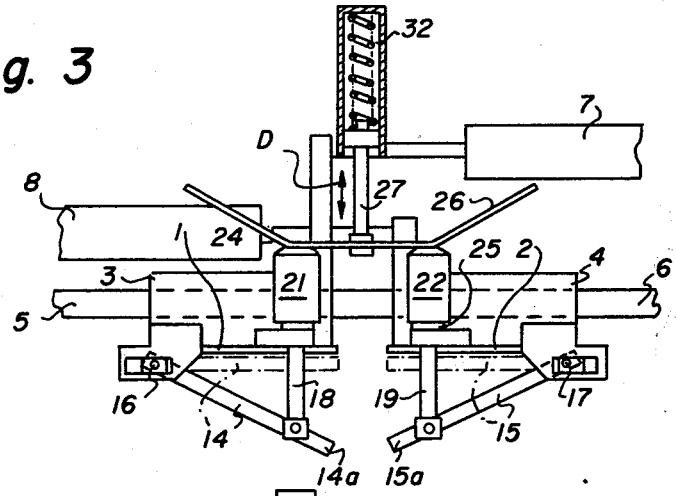
FIG. 3 illustrates part of a further modification of the arrangement of FIG. 1, employing a common compression or pressure spring for both pressing plates in lieu of a Piston-and-cylinder unit, and wherein the remaining structure otherwise is like that shown in FIG. 1.

As shown in FIG. 2 instead of using a common piston-and-cylinder unit 28, as in the arrangement of FIG. 1, for both of the pressing or squeezing plates 14 and 15, it is also possible to provide for each pressing plate 14 and 15 its own hydraulic or pneumatic piston-and-cylinder unit 28*a* and 28*b* respectively. Instead of employing a piston-and-cylinder unit 28 there also can be utilized, as shown in the modified arrangement of FIG. 3, a pressure or compression spring 32 which is common for both of the pressing plates 14 and 15 and which retains these pressing plates 14 and 15 in their lower pivotal position. It is equally furthermore conceivable to provide for each pressing plate 14 and 15 its own pressure spring of the aforementioned type.

The relative movement between the support table 11 and the pressing plates 14 and 15, with the support table 11 stationary, can be accomplished by lowering the pressing plates 14 and 15.

Figure 4:
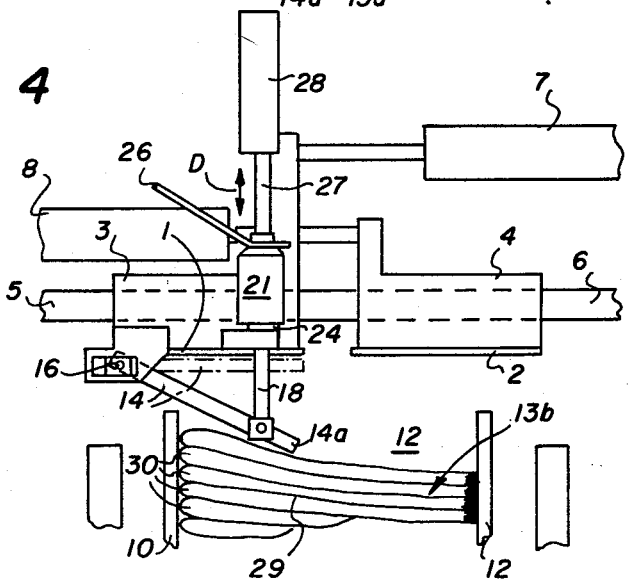
FIG. 4 illustrates part of a still further modification of the the arrangement of FIG. 1, utilizing only one pressing element and wherein the remaining structure otherwise is like that shown in FIG. 1.

In order to squeeze together stacks where all of the products bear against one another at the same side at their folds or folded portions, it is possible shown in FIG. 4, to only provide a single pressing or squeezing plate 14 which then must be arranged in such a manner that it can press against the stack at that side where the products nest against one another at their folds.

Instead of, as described, infeeding the products from above into the receiver compartment 12, it is also possible to deposit the stack which is to be compacted laterally onto the support table 11 or other support element.

The stack which is squeezed together or compacted in the described manner can be, for instance, tied in the receiver compartment 12 or can be ejected out of such receiver compartment 12 for further processing in any desired manner.

While there are shown and described present preferred embodiments of the invention, it is to be distinctly understood that the invention is not limited thereto, but may be otherwise variously embodied and practiced within the scope of the following claims.

Accordingly, what I claim is:

1. An apparatus for compacting a stack of folded, essentially flat products, especially printed products, comprising:

means defining a receiver compartment for the stack;

a support element for closing the receiver compartment at its lower end region;

a counter pressure device arranged above the support element;

means for moving the support element and the counter pressure device relatively towards one another, in order to compress together the product stack arranged between the counter pressure device and the support element;

said counter pressure device comprising at least one pivotable pressing element;

means mounting said pressing element to be pivotable about an essentially horizontal pivot axis;

said pressing element being dispositioned to span the receiver compartment in the direction of the pivot axis;

at least one pressure element acting upon said pressing element;

said mounting means for said pressing element mounting said pressing element for pivotal movement between a lower pivotal position and an upper pivotal position;

said pressing element being pivotable upwardly out of its lower pivotal position where it is inclined towards the support element by the action of the product stack against the action of said at least one pressure element acting upon the pressing element.

2. The apparatus as defined in claim 1, further including:

an additional pressing element;

said pressing element and additional pressing element defining two pressing elements which extend in opposite directions towards the support element;

means for mounting the additional pressing element for pivotal movement about an essentially horizontal pivot axis between a lower pivotal position and an upper pivotal position;

each of said pressing elements being pivoted out of its lower pivotal position about its related essentially horizontal pivot axis against the action of said pressure element;

each of said pressing elements having an end region situated opposite the related pivot axis;

said end regions of said pressing elements coming into contact with said stack and being dispositioned adjacent one another and extending in the direction of the related pivot axis over the receiver compartment.

3. The apparatus as defined in claim 2, wherein:

said pressure element defines at least one common pressure element for both of said pressing elements;

said common pressure element retaining both of the pressing elements in their respective lower pivotal position.

4. The apparatus as defined in claim 2, wherein:

at least one separate pressure element is provided for each pressing element for retaining the associated pressing element in its lower pivotal position.

5. The apparatus as defined in claim 1, wherein:

said at least one pressure element comprises a fluid-operated piston-and-cylinder unit.

6. The apparatus as defined in claim 1, wherein:

said at least one pressure element comprises a compression spring.

7. The apparatus as defined in claim 2, further including:

two displaceable closure elements for selectively closing and opening the receiver compartment at its upper end region;

means for selectively displacing said two closure elements towards and away from one another essentially in horizontal direction;

one said pressing element being pivotably mounted for pivotal movement about its pivot axis at one of said closure elements and the other pressing element being pivotably mounted for pivotal movement about its pivot axis at the other closure element.

8. The apparatus as defined in claim 7, wherein:

said at least one pressure element comprises a common pressure element for both of said pressing elements and serving to retain both of said pressing elements in their lower pivotal positions;

a respective push rod hingedly connected with each pressing element;

said common pressure element comprising a fluid-operated piston-and-cylinder unit which when supplied with pressurized fluid medium downwardly urges said push rods and retains the pressing elements in their lower pivotal positions.

9. The apparatus as defined in claim 8, further including:

at least one spring element which can be tensioned upon rocking the pressing elements into their lower pivotal positions;

said spring element when said piston-and-cylinder unit is vented rocking said pressing elements upwardly into their upper pivotal positions.

10. The apparatus as defined in claim 1, further including:

means for raising and lowering said support element.

* * * * *